US008424358B2

(12) United States Patent
Motoki et al.

(10) Patent No.: US 8,424,358 B2
(45) Date of Patent: Apr. 23, 2013

(54) PRODUCTION EQUIPMENT FOR PRODUCING CORRUGATED FIN

(75) Inventors: Mitsuhiro Motoki, Tokyo (JP); Toshiyuki Nanaarashi, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 256 days.

(21) Appl. No.: 13/023,591

(22) Filed: Feb. 9, 2011

(65) Prior Publication Data

US 2011/0209517 A1 Sep. 1, 2011

(30) Foreign Application Priority Data

Mar. 1, 2010 (JP) ..... 2010-044375

(51) Int. Cl.
*B21D 13/00* (2006.01)
*B21D 17/00* (2006.01)

(52) U.S. Cl.
USPC ..... 72/385; 72/379.6; 72/414

(58) Field of Classification Search ..... 72/381, 72/384, 385, 379.6, 414, 386, 389.6
See application file for complete search history.

(56) References Cited

U.S. PATENT DOCUMENTS 2,510,024 A * 5/1950 Mayer ..... 72/397
2006/0193939 A1 8/2006 Ohtsuka et al.

FOREIGN PATENT DOCUMENTS

JP 4-371322 A 12/1992
JP 9-155461 A 6/1997
JP 2006-263815 A 10/2006

* cited by examiner

*Primary Examiner* — Teresa M Ekiert
(74) *Attorney, Agent, or Firm* — Birch, Stewart, Kolasch & Birch, LLP

(57) ABSTRACT

The corrugated fin production equipment is capable of easily separating a corrugated fin having high ribs from a die after forming the ribs. The corrugated fin production equipment comprises: a lower block; an upper block being moved to and away from the lower block; the die being provided to the lower block and having a concave section; a punch being inserted into the concave section so as to form the rib when the lower block and the upper block are closed; and a movable die constituting a part of the die including the concave section, the movable die being upwardly moved above other parts of the die so as to lift a part of the corrugated fin, in which the rib has been formed, from the underside after the lower die and the upper die are closed to form the corrugated fin.

1 Claim, 10 Drawing Sheets

PRODUCTION EQUIPMENT FOR PRODUCING CORRUGATED FIN

CROSS-REFERENCE TO RELATED APPLICATION

This application is based upon and claims the benefit of priority of the prior Japanese Patent Application No. 2010-044375, filed on Mar. 1, 2010, and the entire contents of which are incorporated herein by reference.

FIELD

The present invention relates to a production equipment for producing a corrugated fin in which a plurality of ribs are formed, at regular intervals, in a metal plate.

BACKGROUND

An example of corrugated fins is shown in FIG. 11. The shown corrugated fin 10 is a flat corrugated fin, in which ribs 12 are vertically formed with respect to a metal plate 9.

In the corrugated fin 10, the metal plate 9 is composed of, for example, aluminum, and the ribs 12 are continuously formed. The corrugated fin 10 is used in a radiator of a vehicle, a heat exchanger of an air conditioner, EGR (Exhaust Gas Recirculation), etc.

Several conventional production equipments for producing the corrugated fin 10 have been known. Japanese Laid-open Patent Publication No. 4-371322 discloses a production equipment for producing a corrugated fin, in which a punch and a die are closed, by one press action of a press unit, to form one rib.

Japanese Laid-open Patent Publication No. 2006-263815 discloses a production equipment for producing a corrugated fin, in which a plurality of punches are sequentially moved toward a plurality of dies. The ribs can be efficiently formed by one die-punch closing action.

Further, Japanese Laid-open Patent Publication No. 9-155461 discloses a lifter for lifting a non-ribbed part, in which a rib is still not formed, upward after forming a rib in another part. In the production equipment disclosed in Japanese Laid-open Patent Publication No. 9-155461, when a lower block and an upper block are opened after completing the closing action of the both for forming the rib, the lifter is moved upward to separate a ribbed part of a metal plate from a die provided to the lower block, and then the metal plate is horizontally moved to form the next rib.

These days, a height of ribs (a depth of grooves between ribs) of a corrugated fin has been increased so as to enhance heat exchange efficiency.

However, if the height or depth is excessively increased, a punch or die will bite a metal plate. Even if the lifter is provided, the metal plate cannot be easily separated from the punch or die.

SUMMARY

Accordingly, it is an object in one aspect of the invention to provide a production equipment for producing a corrugated fin, which is capable of easily separating the corrugated fin having a high rib from a die after forming the rib.

To achieve the object, the corrugated fin production equipment for producing a corrugated fin having a plurality of ribs from a metal plate, comprises:

a lower block;

an upper block being moved to and away from the lower block;

a die being provided to the lower block and having a concave section;

a punch being inserted into the concave section so as to form the ribs when the lower block and the upper block are closed; and a movable die constituting a part of the die including the concave section, the movable die being upwardly moved above other parts of the die so as to lift a part of the corrugated fin, in which the rib has been formed, from the underside after the lower die and the upper die are closed to form the corrugated fin.

With this structure, the part of the die, which has formed the rib, is moved upward, so that the rib can be securely separated from the die.

Preferably, the corrugated fin production equipment further comprises a lifter being capable of contacting a lower face of a non-ribbed part of the corrugated fin, which is located on the upstream side in the conveying direction of the metal plate and in which a rib is still not formed, and a lower face of the formed rib, which is located on the downstream side in the conveying direction of the metal plate, and the lifter lifts the non-ribbed part of the corrugated fin and the formed rib, from the underside, after the lower die and the upper die are closed to form the corrugated fin.

With this structure, the corrugated fin, in which the rib has been formed, can be further securely separated from the die.

Preferably, the movable die and the lifter are simultaneously started to be moved upward after the lower die and the upper die are closed to form the corrugated fin, the upward movement of the movable die is firstly stopped, and the upward movement of the lifter is stopped at a position above the stop position of the movable die.

With this structure, the movable die and the lifter are simultaneously moved upward, so that forces are equally applied to the ribbed part and the non-ribbed part. Therefore, deformation of the corrugated fin can be prevented. Further, the lifter is upwardly moved to the position above the stop position of the movable die, so that the lifter lifts and separates the rib from the concave section of the movable die.

By employing the corrugated fin production equipment of the present invention, the corrugated fin, in which the rib has been formed, can be securely separated from the die.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

In the following embodiments, the production equipment for producing a corrugated fin has a plurality of punches, and a plurality of ribs are simultaneously formed by one closing action of a lower block and an upper block.

Note that, the present invention is not limited to the following embodiments, in which a plurality of the ribs are formed by one closing action of the blocks. One rib may be formed by one closing action of the blocks.

Figure 1:
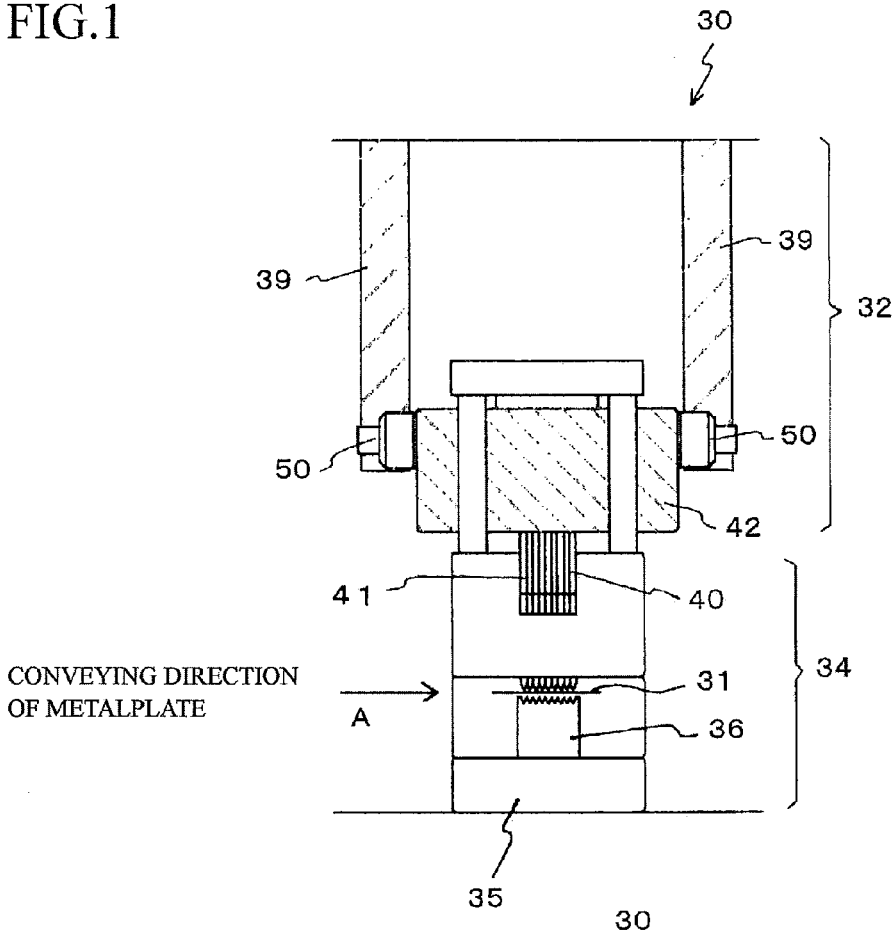
FIG. 1 is a side view of the production equipment relating to the present invention.
Figure 2:
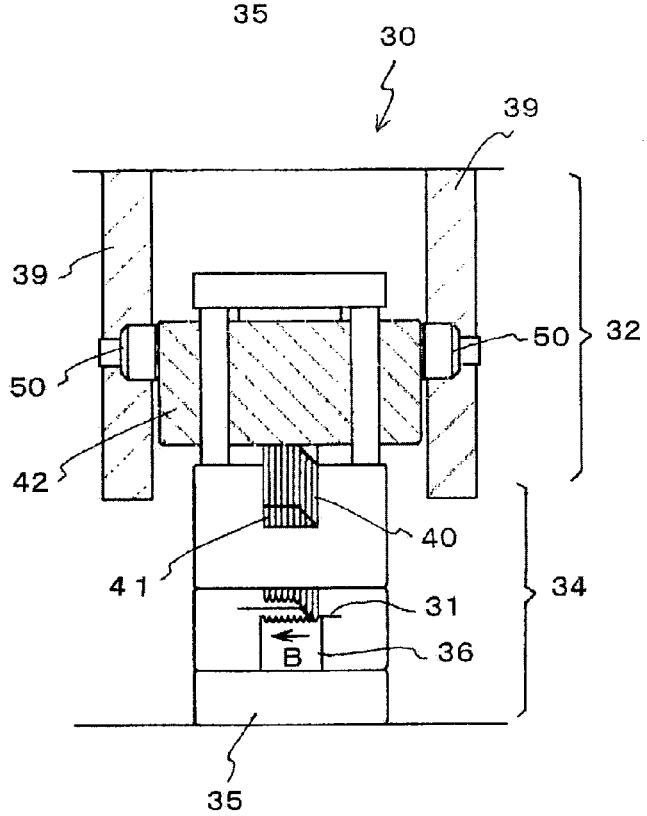
FIG. 2 is an explanation view of the production equipment shown in FIG. 1, in which punches are sequentially moved downward.
Figure 3:
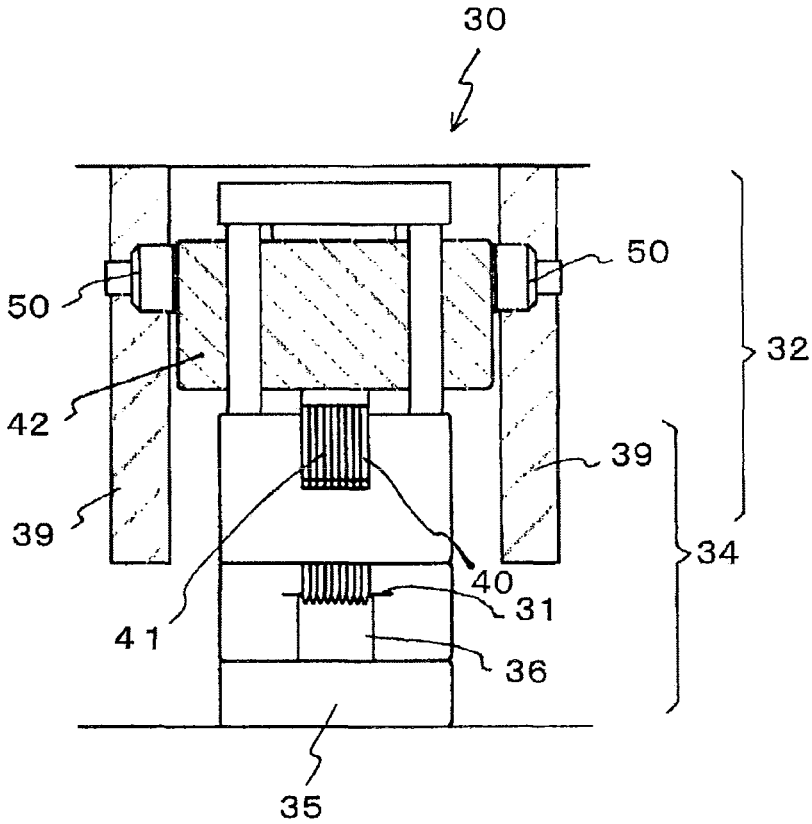
FIG. 3 is an explanation view of the production equipment shown in FIG. 1, in which all of the punches have been moved downward to completely form ribs.

FIG. 1 shows a schematic structure of the production equipment relating to the present invention. In FIGS. 2 and 3, punches are actuated to form ribs.

Figure 4:
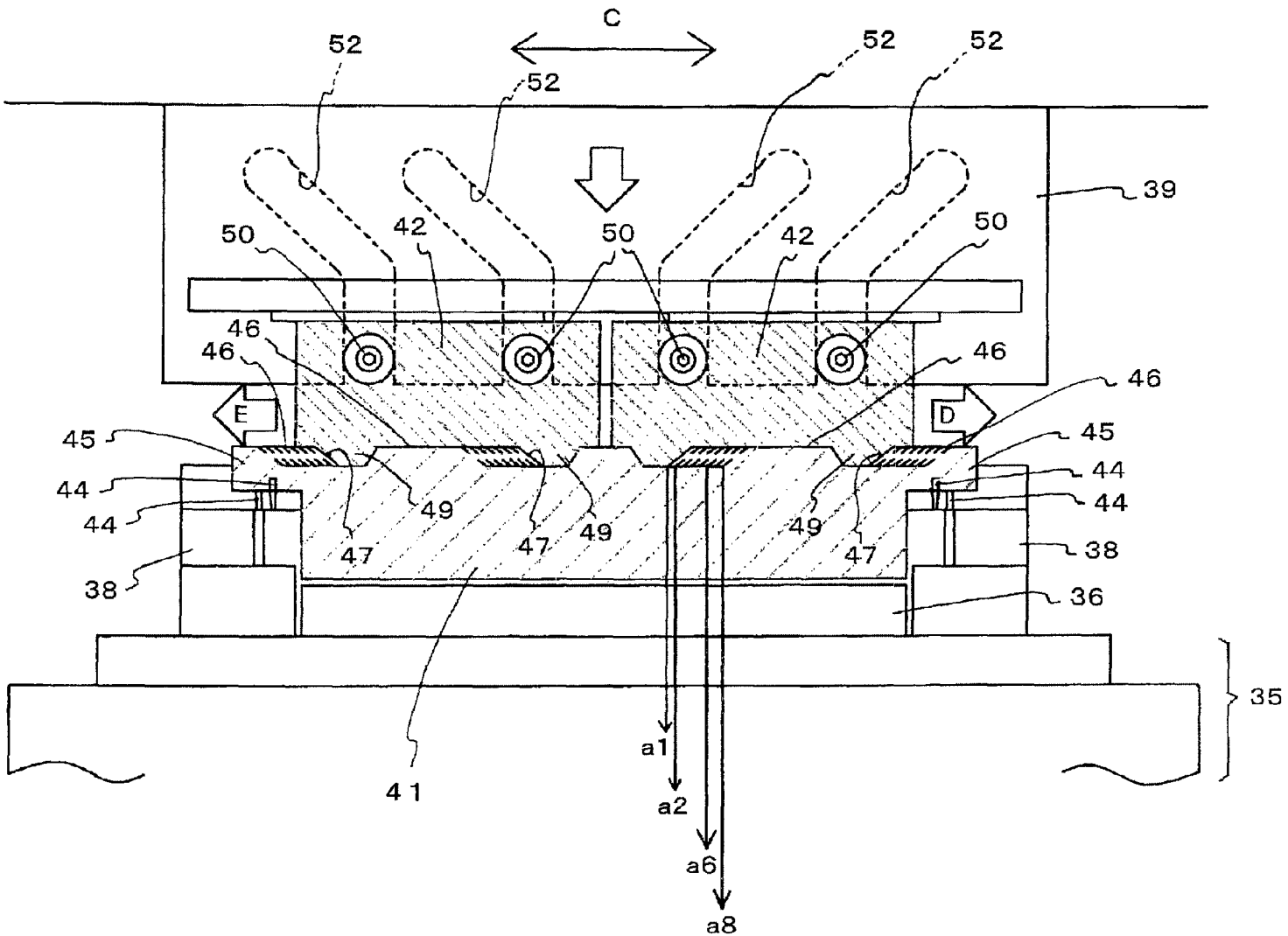
FIG. 4 is a front view of the production equipment.
Figure 5:
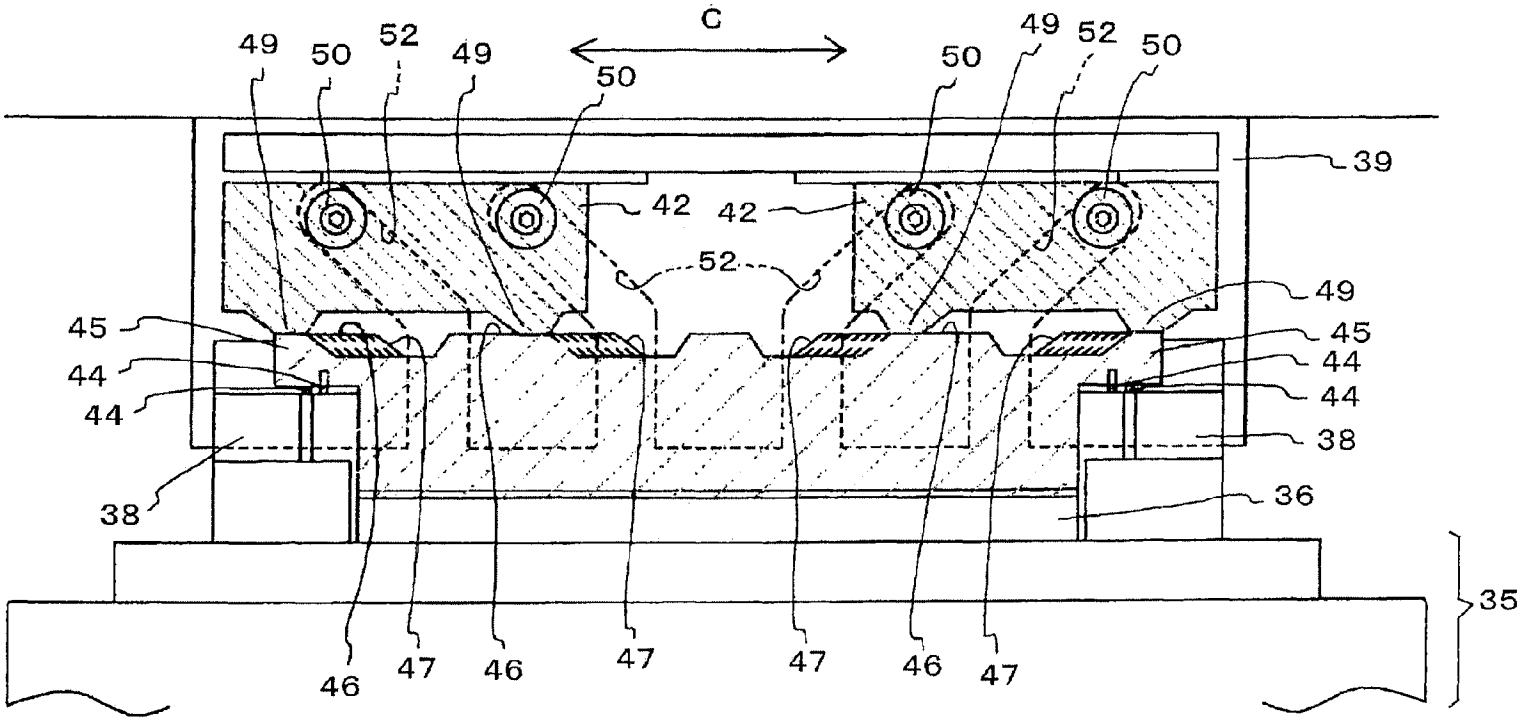
FIG. 5 is an explanation view of the production equipment shown in FIG. 4, in which all of the punches have been moved downward to completely form the ribs.

FIGS. 4 and 5 are side views of the production equipment shown in FIGS. 1-3.

Figure 11:
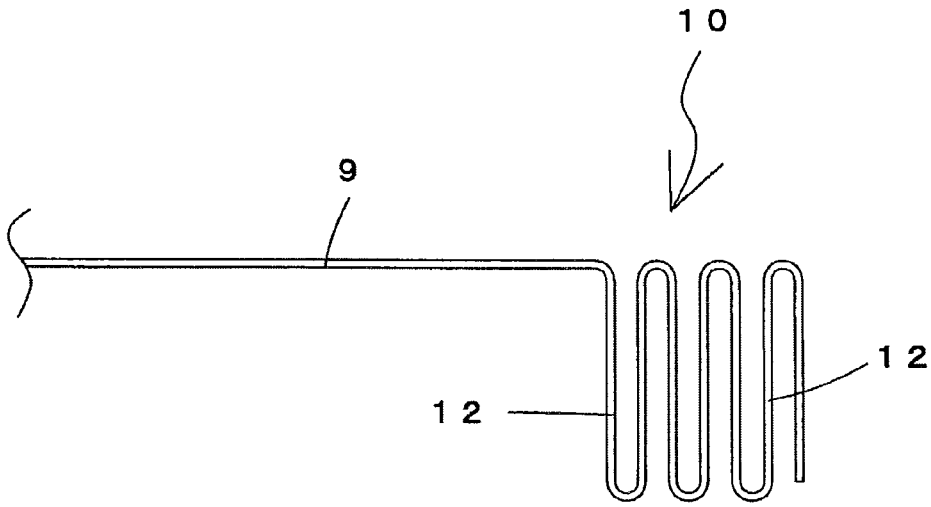
FIG.11 PRIOR ART
FIG. 11 is a side view of the corrugated fin.

The production equipment 30 produces a corrugated fin 10 having a plurality of ribs 12 (see FIG. 11) by pressing a thin metal plate 31 composed of a metal, e.g., copper, aluminum, with a die and punches.

The production equipment 30 has a lower block 34 and an upper block 32 which is moved to and away from the lower block 34.

The lower block 34 includes: a base 35; a die 36 fixed on the base 35; a plurality of punches 40 and 41; and two press cam blocks 42 located above the punches 40 and 41. The upper block 32 includes: cam plates 39 which can be moved upward and downward; and a driving mechanism (not shown) for moving the cam plates 39 upward and downward. For example, a hydraulic cylinder unit is used as the driving mechanism.

Figure 6:
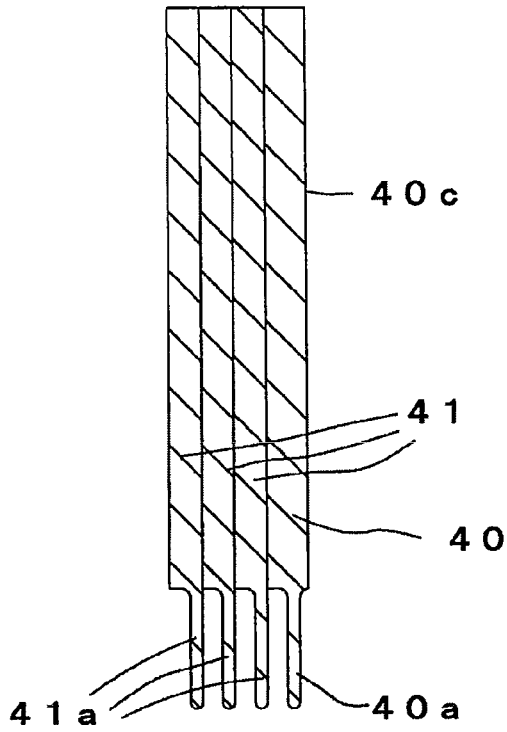
FIG. 6 shows a side sectional view of punches and a side sectional view of a die.
Figure 6:
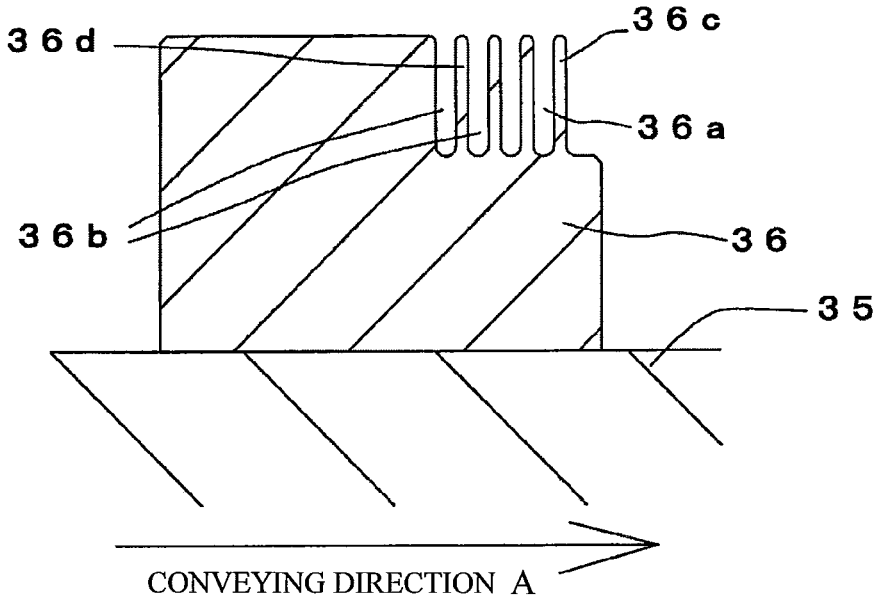

The lower block 34 and the upper block 32 will be explained with reference to FIG. 6.

The die 36 is fixed on the upper face of the base 35 and has a plurality of concave sections and convex sections which correspond to the ribs 12 to be formed in the metal plate 31. For example, as shown in FIG. 6, four concave sections and four convex sections are formed. Lower end parts 41*a* of the punches 41 can be respectively inserted into the concave sections of the die 36 so as to bend the metal plate 31. The convex sections of the die 36 form mountain-shaped parts of the ribs 12.

The concave sections of the die 36 are arranged in a conveying direction A of the metal plate 31. The concave section 36*a*, which is the rightmost concave section in the conveying direction A, is a pilot concave section into which the formed rib 12 is fitted so as to correctly position the metal plate 31.

The concave sections 36*b* are process concave sections for forming the ribs 12 with the process punches 41. The lower end parts 41*a* of the process punches 41 are sequentially inserted into the process concave sections 36*b* from the downstream side of the conveying direction A to the upstream side thereof, so that the metal plate 31 is bent to form the ribs 12 sequentially.

A side wall face of the pilot concave section 36*a* on the downstream side of the conveying direction A is upwardly erected to form a convex section 36*c*, which can be inserted into the formed rib 12. When the blocks 32 and 34 are closed, the convex section 36*c* faces a side face of the pilot punch 40 on the downstream side, so that the formed rib 12 can be held by the convex section 36*c* and the pilot punch 40.

The convex sections 36*d* can be inserted into spaces, each of which is formed between the adjacent process punches 41.

The plurality of punches 40 and 41 are provided above the die 36 and arranged in the conveying direction A of the metal plate 31.

The rightmost punch in the conveying direction A is the pilot punch 40. The lower end part 40*a* of the pilot punch 40 can be inserted into the pilot concave section 36*a*. The lower end part 40*a* is located in a central part of the pilot punch 40 in the conveying direction A. A side face 40*c* of the pilot punch 40, on the downstream side of the conveying direction A, is formed as a vertical flat face. Since the lower end part 40*a* is located on the upstream side with respect to the side face 40*c*, a space is formed between the side face 40*c* and a side face of the lower end part 40*a* on the downstream side. When the blocks 32 and 34 are closed, the convex sections 36*c* of the die 36 can be inserted into the space.

The pilot punch 40 is moved downward earlier than the process punches 41 so as to hold the formed rib 12, which has been previously formed, with the pilot concave section 36*a*, so that the metal plate 31 can be correctly positioned.

The plurality of process punches 41 are located on the upstream side of the conveying direction A with respect to the pilot punch 40. The process punches 41 are sequentially moved downward, from the rightmost punch 41 located on the downstream side to the leftmost punch 41 located on the upstream side, so as to bend the metal plate 31 and form the ribs 12.

The lower end parts 41*a* of the process punches 41 can be respectively inserted into the process concave sections 36*b*.

The metal plate 31, which has been correctly positioned by the pilot punch 40 and the pilot concave section 36*a*, is sequentially clamped by the lower end parts 41*a* of the process punches 41 and the process concave sections 36*b*, so that the ribs 12 can be formed sequentially.

Next, the lower block 34 will be explained with reference to FIGS. 7-9.

Figure 7:
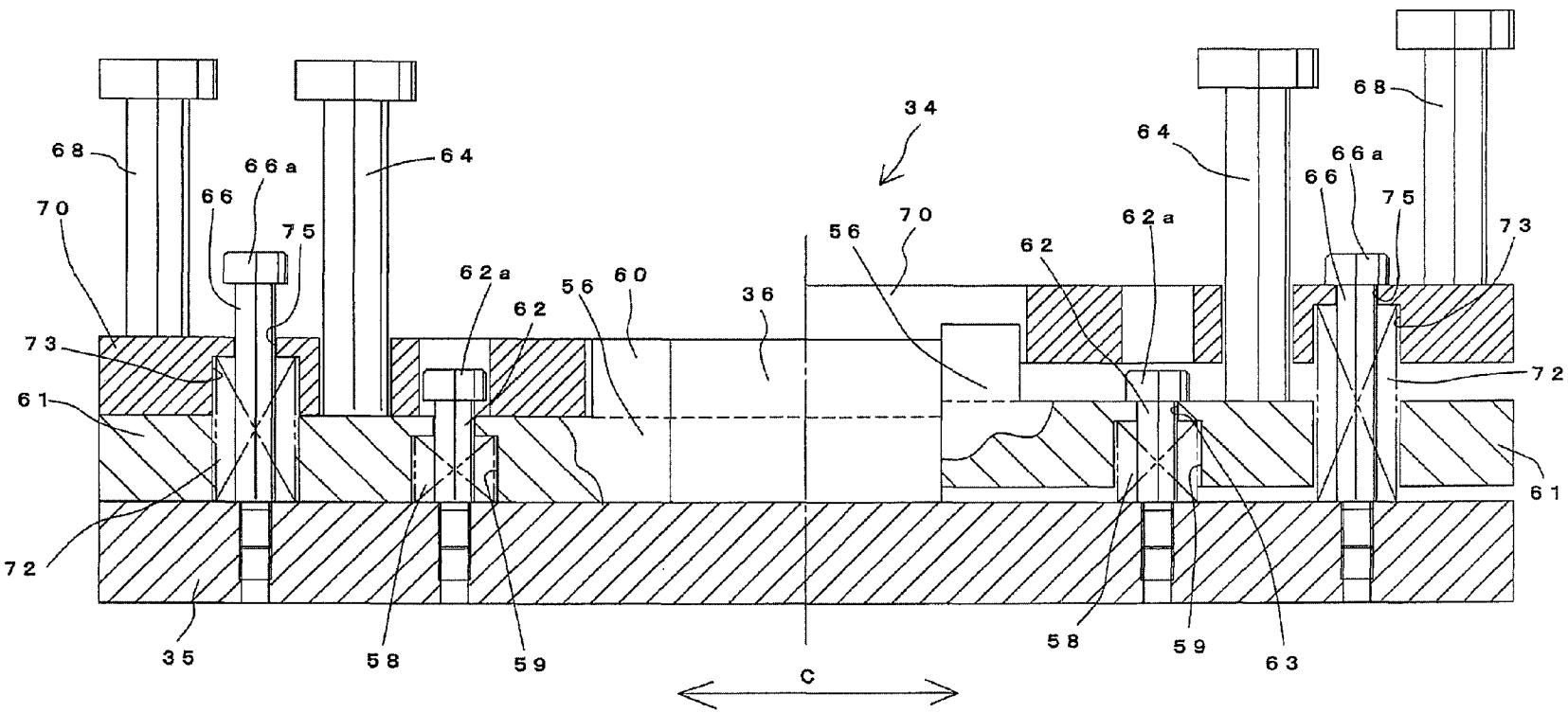
FIG. 7 is a side sectional view of a lower block.

FIG. 7 is a sectional front view of the entire lower block 34 seen from the conveying direction A. On the left side of the drawing, lifters 70 and movable dies 56 are not actuated; on the right side thereof, the lifters 70 and the movable dies 56 are actuated.

Figure 8:
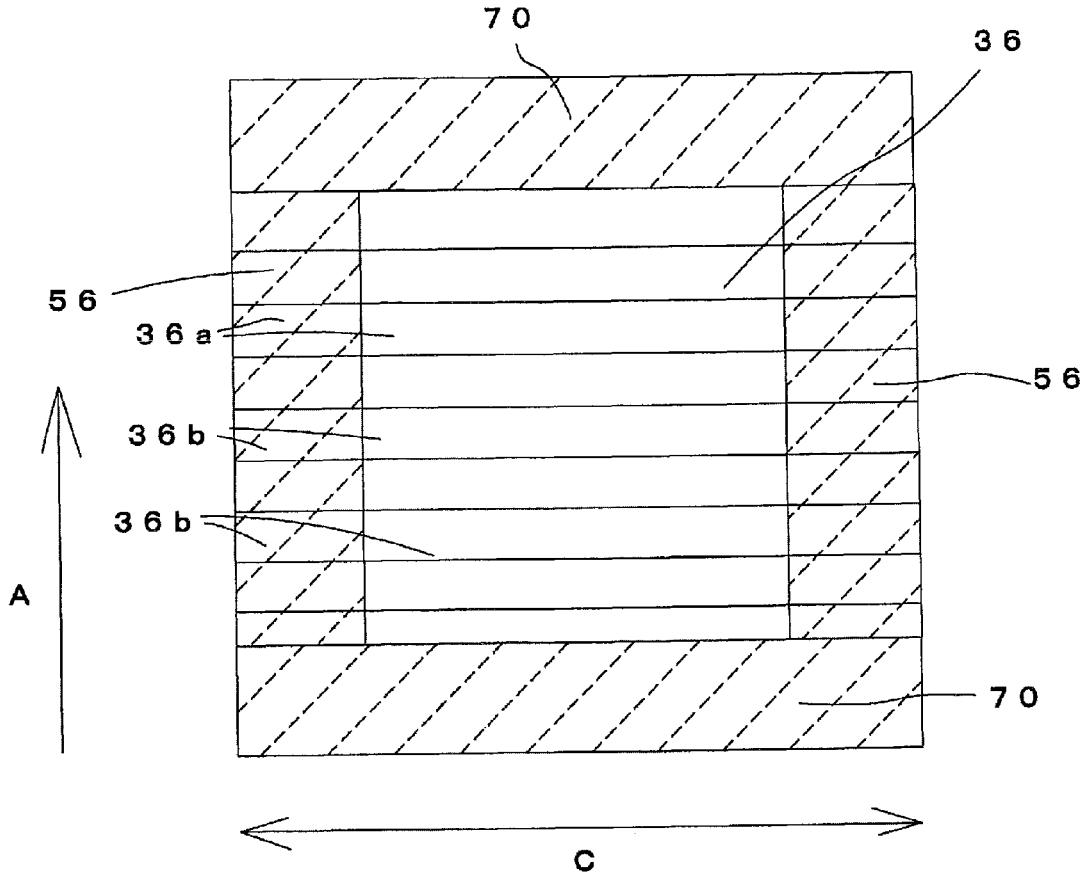
FIG. 8 is a plan sectional view of the lower block.
Figure 9:
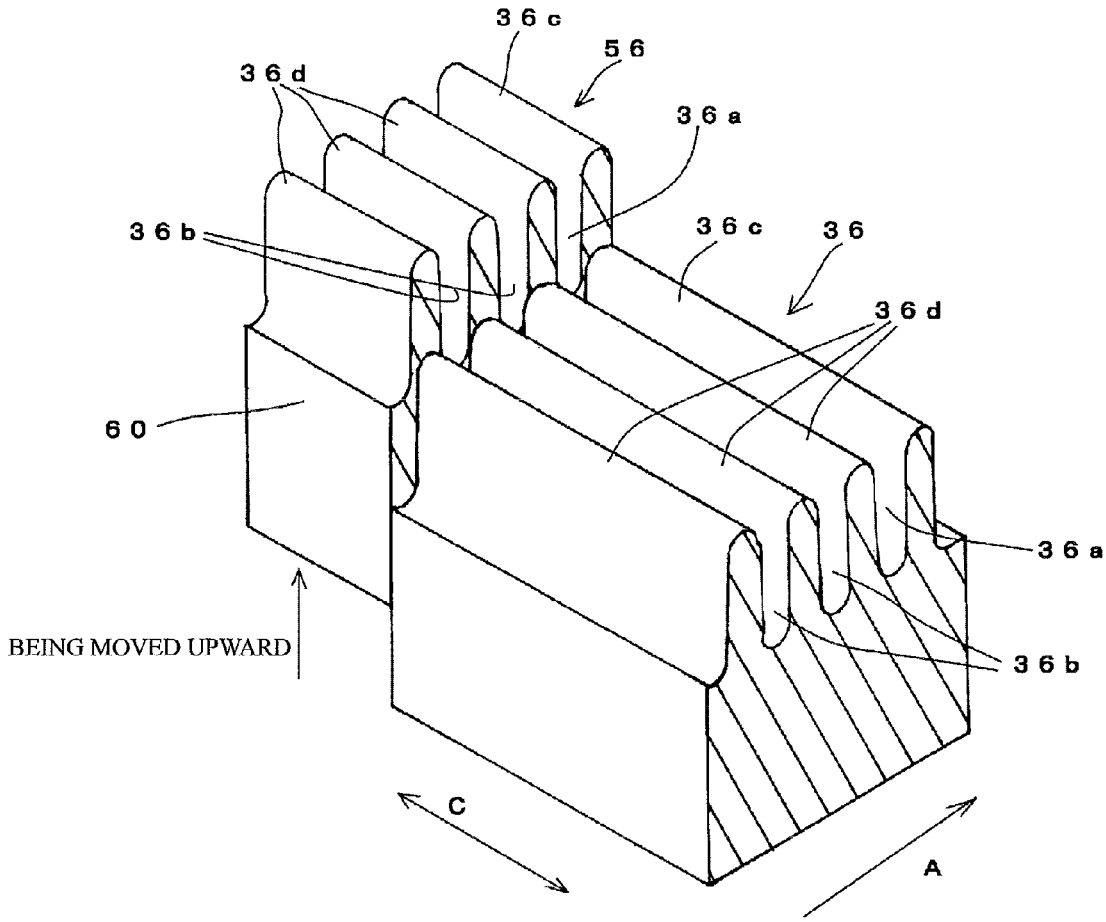
FIG. 9 is an explanation view, in which a movable die is moved upward with respect to the die.

FIG. 8 is a plan sectional view of the lower block 34, and FIG. 9 is an explanation view, in which the movable die 56 is moved upward with respect to the die 36.

The die 36 and the movable dies 56, which constitute parts of the die 36, are provided on the base 35. In the present embodiment, the movable dies 56 are respectively provided on the both sides with respect to the center of the die 36 in a width direction c.

Each of the movable die 56 has a main body part 60, which includes the concave sections and the convex sections, and a mounting part 61, which is extended from the main body part 60 sideward. In the main body part 60 of the movable die 56, the concave sections 36*a* and 36*b* and the convex sections 36*d*, which are communicated to the concave sections 36*a* and 36*b* and the convex sections 36*d* of the die 36 (see FIG. 9), are formed in the direction c.

As described above, the production equipment 30 of the present embodiment has at least two movable dies 56. However, number of the movable dies 56 is not limited to two. The production equipment 30 may have one movable die 56.

For example, the center part of the die 36, in the direction c, may be the movable die 56, and the both side parts of the movable die 56 may act as the die 36 which are fixed on the base 35.

Biasing members 58, which respectively bias the movable dies 56 upward, are provided to the mounting parts 61 of the movable dies 56. In the present embodiment, the biasing members 58 are coil springs, which are respectively accommodated in accommodating sections 59 opened in lower faces of the movable dies 56. Each of the springs 58 covers a fixed pin 62, which is vertically pierced through the accommodating section 59, and is provided between an upper face of the base 35 and an inner upper face (ceiling face) of the accommodating section 59 in a compressed state.

Further, lower ends of killer pins 64 contact upper faces of the mounting parts 61 of the movable dies 56 so as to restrict the movement of the movable dies 56.

As shown in the left side part of FIG. 7, the killer pin 64 has been moved downward so as to press the upper face of the mounting part 61 of the movable die 56 downward against the elasticity of the spring 58 when the movable die 56 is located at a lower position (in a state where the concave sections and the convex sections of the movable die 56 are communicated to those of the die 36 and the punches can form the ribs). In this state, a lower face of the movable die 56 contacts the upper face of the base 35.

As shown in the right side part of FIG. 7, the killer pin 64 is moved upward when the movable die 56 is moved upward (when the completed corrugated fin, in which the ribs 12 have been formed, is separated from the die 36). With this action, the spring 58, whose lower end contacts the upper face of the base 35, is extended, so that the spring 58 pushes the inner upper face of the accommodating section 59 and the movable die 56 is moved upward.

Note that, a flange 62*a* is formed at an upper end of each of the fixed pins 62. A diameter of the flange 62*a* is greater than that of a through-hole 63, through which the fixed pin 62 is pierced. When the movable die 56 is moved upward, the upper face of the movable die 56 contacts the flange 62*a*, so that the upward movement of the movable die 56 is stopped.

Namely, a distance of the upward movement of the movable die 56 can be adjusted by changing the position (height) of the flange 62*a* of the fixed pin 62.

The lifters 70 are located on the upstream side and the downstream side of the die 36 including the movable dies 56, in the conveying direction A.

The lifters 70 are flat plates. The lifters 70 lift a non-ribbed part of the metal plate 31 and a ribbed part thereof, from the underside, so as to separate the metal plate 31 from the die 36. In the present embodiment, actions of the lifters 70 are linked with actions of the movable dies 56.

In the present embodiment, the lifters 70 are provided above the mounting parts 61 of the movable dies 56, and biasing members 72 bias the lifters 70 upward with respect to the movable dies 56. In the present embodiment, the biasing members 72 are coil springs, which are respectively accommodated in accommodating sections 73 opened in lower faces of the lifters 70 and through-holes formed in the mounting sections 61 of the movable dies 56. The springs 72 are respectively pierced through the mounting sections 61 of the movable dies 56 and provided between the upper face of the base 35 and inner upper faces (ceiling faces) of the accommodating sections 73 in a compressed state. The springs 72 respectively cover fixed pins 66, which are vertically pierced through the accommodating sections 73 and whose lower ends are fixed to the base 35.

Further, lower ends of killer pins 68 contact upper faces of the lifters 70 so as to restrict the movement of the lifters 70.

As shown in the left side part of FIG. 7, the killer pin 68 has been moved downward so as to downwardly press the upper face of the lifter 70 against the elasticity of the spring 72 when the lifter 70 is located at a lower position. In this state, a lower face of the lifter 70 contacts the upper face of the mounting section 61 of the movable die 56.

As shown in the right side part of FIG. 7, the killer pin 68 is moved upward when the lifter 70 is moved upward (when the completed corrugated fin, in which the ribs have been formed, is separated from the die). With this action, the spring 72, whose lower end contacts the upper face of the base 35, is extended, so that the spring 72 pushes the inner upper face of the accommodating section 73 and the lifter 70 is moved upward.

Note that, a flange 66*a* is formed at an upper end of each of the fixed pins 66. A diameter of the flange 66*a* is greater than that of a through-hole 75, through which the fixed pin 66 is pierced. When the lifter 70 is moved upward, the upper face of the lifter 70 contacts the flange 66*a*, so that the upward movement of the lifter 70 is stopped.

Namely, a distance of the upward movement of the lifter 70 can be adjusted by changing the position (height) of the flange 66*a* of the fixed pin 66.

In the present embodiment, the movable dies 56 and the lifters 70 are simultaneously moved upward when the completed ribs are separated from the die. For example, the movable dies 56 and the lifters 70 are simultaneously started to be moved upward by simultaneously moving the killer pins 64, which press the movable dies 56 downward, and the killer pins 68, which press the lifters 70 downward, upward.

Stop positions of the lifters 70, at which the upward movement of the lifters 70 are stopped, are above stop positions of the movable dies 56, at which the upward movement of the movable dies 56 are stopped. Namely, a height of lifting the corrugated fin by the lifters 70 is higher than that by the movable dies 56.

With this structure, the movable dies 56 can securely separate the ribs from the concave sections of the die 36, and the lifters 70 can separate the ribs from the concave sections of the movable dies 56.

Next, a structure for sequentially moving the punches downward by one block closing action will be explained with reference to FIGS. 4, 5 and 10.

Figure 10:
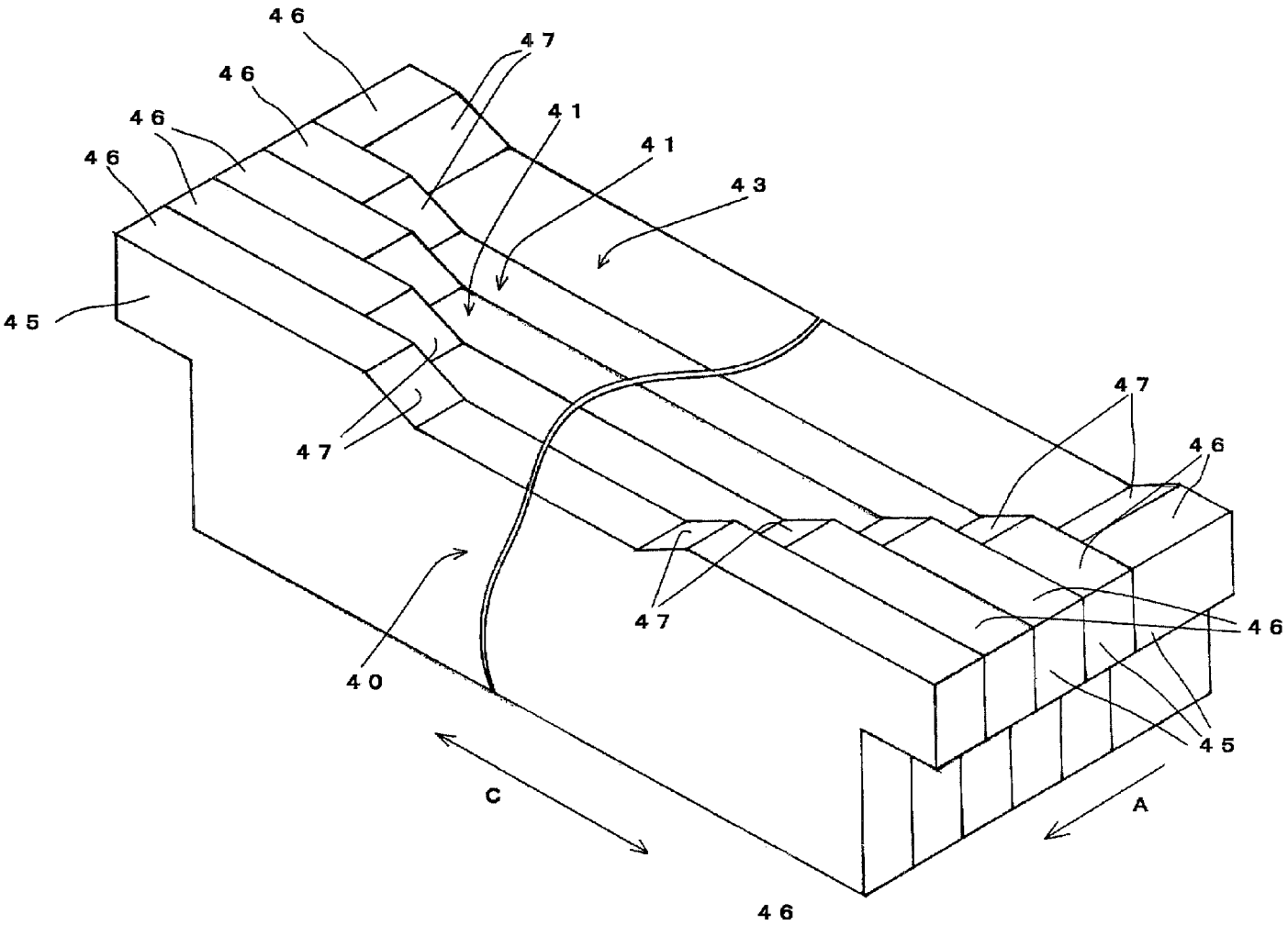
FIG. 10 is a perspective view of the punches.

As shown in FIG. 10, the punches 40 and 41 are elongated in the direction c, which is perpendicular to the conveying direction A.

Both ends of each of the punches 40 and 41, in the direction c, are attachment sections 45 which are used to attach the punches 40 and 41 to the base 35 of the lower block 34. Biasing members 44 are provided between the attachment sections 45 and punch supporting sections 38 of the base 35 so as to bias the punches 40 and 41 upward. In the present embodiment, the biasing members 44 are coil springs which are vertically compressed.

Projected sections 46 are formed at upper ends of the punches 40 and 41. Press cam blocks 42 have press sections 49, which are projected downward from lower faces thereof. The press sections 49 respectively contact the projected sections 46 so as to actuate the punches 40 and 41. The projected sections 46 respectively have slope faces 47 so as to easily guide the press sections 49. In the present embodiment, each of the punches 40 and 41 has four projected sections 46, and they are arranged in the direction c.

Lengths of upper faces of the projected sections 46, in the direction c, are gradually reduced in order of bending the metal plate 31 as shown in FIG. 10. Note that, in the present embodiment, eight punches are provided, but some of the punches and the lower end parts of the punches are omitted in FIG. 10.

In the present embodiment, the ribs 12 are sequentially formed, from the front end of the metal plate 31, in a direction B (see FIG. 2). Therefore, the pilot punch 40 is the first punch of the punches arranged in the conveying direction A, so the length of the projected sections 46, in the direction c, is longer than those of other punches. The lengths of the projected sections 46 of the punches, in the direction c, are gradually reduced toward the following punches (toward the upstream side in the conveying direction A).

In FIGS. 4 and 5, the pilot punch 40 is firstly moved toward the die 36, so the slope face 47 of each of the projected sections 46 is located at position a1, which is closest to the press section 49 of the press cam block 42. As to the punch 41 which is secondly moved toward the die 36, the slope face 47 of each of the projected sections 46 is located at position a2, which is secondly closest to the press section 49 of the press cam block 42.

As to the following punches 41, distances between the slope faces 47 and the press section 49 of the press cam block 42 are gradually increased in order of being moved toward the die 36. As to the final punch 41 which is eighthly moved toward the die 36, the slope face 47 of each of the projected sections 46 is located at position a8, which is farthest from the press section 49 of the press cam block 42.

The cam blocks 42 are provided above the punches 40 and 41 and always contact the upper faces of the punches 40 and 41. When the upper block 32 and the lower block 34 are opened, the press sections 49 of the press cam blocks 42 contact the punches 40 and 41 other than the projected sections 46. When the blocks 32 and 34 are closed, the press sections 49 of the press cam blocks 42 contact at least one of projected sections 46 of the punches 40 and 41.

In the present embodiment, two press cam blocks 42 are respectively provided on the both sides with respect to the center of the punches in the direction c. The press cam blocks 42 can be moved in the direction c. The movements of the press cam blocks 42 are restricted by the cam plates 39 of the upper block 32.

In the present embodiment, when the upper block 32 and the lower block 34 are opened, the two cam blocks 42 are shifted to the center of the punches 40 and 41 in the direction c (see FIG. 4). On the other hand, when the blocks 32 and 34 are closed, the two cam blocks 42 are moved away, in the width direction c, from each other (see FIG. 5).

The two press sections 49 are extended from a lower face of each of the press cam blocks 42. Length of each of the press sections 49, in the direction c, is gradually reduced toward the lower end. Namely, the press sections 49 have tapered shapes. When the upper block 32 and the lower block 34 are opened, the press sections 49 contact no projected sections 46 of the punches 40 and 41 (see FIG. 4). On the other hand, when the blocks 32 and 34 are closed, the press cam blocks 42 are moved in the direction c and moved on the slope faces 47 of the projected sections 46. Then, the press sections 49 move the punches 40 and 41 downward, against the elasticity of the biasing members 44, from the first punch having the longest projected section 46 (see FIG. 5).

The cam plates 39 are provided to the upper block 32 and have cam grooves 52, in which bearings 50 provided to the press cam blocks 42 can be accommodated respectively.

The shapes of the cam grooves 52 are designed to make the press cam blocks 42 move in the direction c with the downward movement of the cam plates 39. Namely, the cam grooves 52 are inclined so as to gradually move the bearings 50 in the direction c.

For example, to move the right cam block 42 shown in FIG. 4 in a direction D, the corresponding groove 52 is extended upward to the right. On the other hand, to move the left cam block 42 shown in FIG. 4 in a direction E, the corresponding groove 52 is extended upward to the left.

In the present invention, rotors may be employed instead of the press sections 49 of the press cam blocks 42. Long rollers or balls may be arranged, as the rotors, in the conveying direction A of the metal plate 31.

In the above described embodiment, the two press cam blocks 42 are moved away from each other when the blocks 32 and 34 are closed. However, they are not limited to the above described example. The two cam blocks 42 may be located at both outmost ends in the direction c when the blocks 32 and 34 are opened, and they may be moved close to each other so as to sequentially move the punches 40 and 41 downward when the blocks 32 and 34 are closed.

Successively, the method of producing the corrugated fin performed in the production equipment 30 will be explained.

In the state of opening the upper block 32 and the lower block 34, a conveyor unit (not shown) conveys the metal plate 31 to a position between the die 36 and the punches 40 and 41.

When the blocks 32 and 34 are started to be closed, the upper block 32 is moved toward the lower block 34. With this action, the cam plates 39 are also moved downward. The bearings 50 of the press cam blocks 42 are moved along the cam grooves 52 of the cam plates 39, so that the press cam blocks 42 are moved horizontally.

The two press cam blocks 42 are horizontally moved away from each other, in the directions D and E shown in FIG. 4, by the cam plates 39.

Then, the press sections 49, which are provided at the lower ends of the press cam blocks 42, are moved onto the upper faces of the projected sections 46 of the pilot punch 40, which should be firstly moved downward, to move the pilot punch 40 downward.

By further moving the press cam blocks 42 in the horizontal direction, the press corn blocks 42 sequentially moves the punches 41 downward in descending order of the length of the upper faces of the projected sections 46 (in ascending order of the distance between the center of the punches 41, in the direction c, and the slope faces 47 of the projected sections 46).

The process punches 41 bend the metal plate 31 with the die 36. The process punches 41 are sequentially moved downward from the downstream side of the conveying direction A, so that the ribs 12 can be sequentially formed in the metal plate 31.

When the upper block 32 reaches a lower dead point, the press sections 49 of the press cam blocks 42 contact the upper faces of the punch 41 finally moved downward. In this state, all of the punches 40 and 41 have been moved downward, so that all of the ribs 12 are completely formed.

Then, the driving mechanism (not shown) moves the upper block 32 upward.

By moving the upper block 32 upward, the cam plates 39 are also moved upward, so that the bearings 50 are moved along the cam grooves 52 and the press cam blocks 42 are moved toward the center of the punches 40 and 41 in the direction c.

With this action, the press sections 49 of the two press cam blocks 42 are sequentially separated from the upper faces of the projected sections 46 of the punches 40 and 41. Namely, the press cam blocks 42 release the projected sections 46 in ascending order of the length of the upper faces in the direction c, and the released punches 40 and 41 are sequentially moved upward by the elasticity of the biasing members 44. The punches 40 and 41 are moved upward in reverse order with respect to the order of moving downward. When the press sections 49 of the press cam blocks 42 are separated from the projected sections 46 of all of the punches 40 and 41, the upper block 32 reaches an upper dead point, and one closing action of the blocks 32 and 34 is completed.

When the upper block 32 and the lower block 34 are opened, an actuator (not shown), e.g., hydraulic cylinder unit, moves the killer pins 64 and 68, which have been pressed downward, upward.

Then, the movable dies 56 and the lifters 70 are simultaneously moved upward. Since the concave sections for forming the ribs 12 are continuously formed in the movable dies 56 and the die 36, even high ribs 12 can be securely separated from the die 36. Further, the lifters 70 are stopped at the positions above the movable dies 56, so that the ribs 12 can be separated from the movable dies 56 by the lifters 70.

The corrugated fin 10, which has been separated from the die 36, is conveyed to outside of the production equipment by a conveyor unit (not shown). By conveying the corrugated fin 10, the method of producing the corrugated fin is completed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A production equipment for producing a corrugated fin having a plurality of ribs from a metal plate, comprising:

a lower block;

an upper block being moved to and away from the lower block;

a die being provided to the lower block and having a concave section;

a punch being inserted into the concave section so as to form the rib when the lower block and the upper block are closed; and a movable die constituting a part of the die including the concave section, the movable die being upwardly moved above other parts of the die so as to lift a part of the corrugated fin, in which the rib has been formed, from the underside after the lower block and the upper block are closed to form the corrugated fin, a lifter being capable of contacting a lower face of a non-ribbed part of the corrugated fin, which is located on an upstream side in a feeding direction of the metal plate and in which a rib is still not formed, and a lower face of the formed rib, which is located on a downstream side in the feeding direction of the metal plate, the lifter lifting the non-ribbed part of the corrugated fin and the formed rib, from the underside, after the lower block and the upper block are closed to form the corrugated fin, wherein the movable die and the lifter are simultaneously started to be moved upward after the lower block and the upper block are closed to form the corrugated fin, the upward movement of the movable die is firstly stopped, and the upward movement of the lifter is stopped at a position above the stop position of the movable die, wherein the movable die has a through-hole, through which a shaft part of a fixed pin is pierced, a flange is formed at an upper end of the fixed pin, a diameter of the flange is greater than that of the through-hole, and when the movable die is moved upward, an upper face of the movable die contacts the flange, whereby the upward movement of the movable die is stopped.

* * * * *